United States Patent [19]

Merz et al.

[11] 4,057,777

[45] Nov. 8, 1977

[54] TERMINATION FOR ELECTRICAL RESISTOR AND METHOD OF MAKING SAME

[75] Inventors: Kenneth M. Merz, Gladwyne; Howard E. Shapiro, Philadelphia, both of Pa.

[73] Assignee: TRW Inc., Cleveland, Ohio

[21] Appl. No.: 633,398

[22] Filed: Nov. 19, 1975

[51] Int. Cl.[2] ..... H01C 1/012

[52] U.S. Cl. ..... 338/309; 29/621; 106/47 R; 252/512; 252/518; 252/515; 252/516; 252/519; 338/327; 338/328; 357/67; 427/102; 428/433

[58] Field of Search ..... 338/322, 314, 327, 328, 338/307–309; 357/67; 252/512, 513, 518, 519; 106/47, 48, 49; 427/126, 101, 123, 102, 103; 29/621, 619; 428/433

[56] References Cited

U.S. PATENT DOCUMENTS

| | | | |
|---|---|---|---|
| 2,679,568 | 5/1954 | Smith et al. | 338/328 X |
| 3,218,594 | 11/1965 | Ganci | 338/293 |
| 3,360,761 | 12/1967 | Stapleton et al. | 338/330 |
| 3,394,087 | 7/1968 | Huang | 106/48 X |
| 3,508,938 | 4/1970 | Jones | 106/48 |

OTHER PUBLICATIONS

Driver Harris Company Technical Catalog NCR58, Properties of Metals and Alloys pp. 3–5.

The Tophet Alloys, Wilbur B. Driver Company, Nickel-Chromium Alloy System, p. 40.

Kovar Alloy Handbook, Westinghouse Electric Corporation, Properties, pp. 6–10.

Carpenter Alloys for Electronic, Magnetic and Electrical Applications pp. 3, 4, 48, 46, 60, 61.

*Primary Examiner*—C. L. Albritton

*Attorney, Agent, or Firm*—Jacob Trachtman

[57] ABSTRACT

A termination material for a vitreous enamel electrical resistor which includes a mixture of a glass frit and particles of nickel and iron. The termination material is applied to a substrate and fired to melt the glass frit, and then cooled to form a layer of the glass with particles of an alloy of nickel and iron embedded therein. The termination material may be applied to the substrate either before or after the resistance material is applied to the substrate.

38 Claims, 2 Drawing Figures

FIG. 1
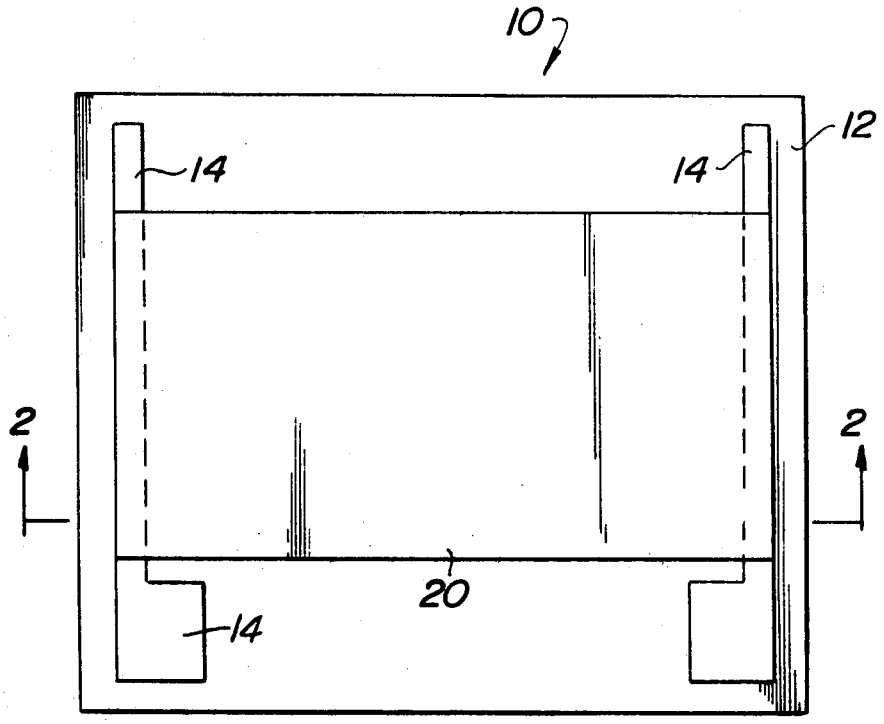
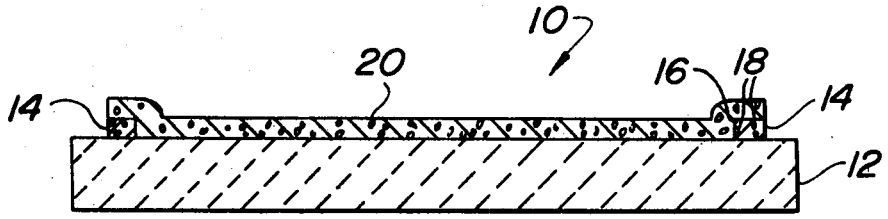
FIG. 2

TERMINATION FOR ELECTRICAL RESISTOR AND METHOD OF MAKING SAME

The present invention relates to a conductive termination for an electrical resistor and method of making same, and particularly to a vitreous enamel termination for a vitreous enamel resistor.

A type of resistance material which has come into use is the vitreous enamel resistance material which comprises a mixture of particles of a conductive material and a glass frit. To form a resistor, the vitreous enamel resistance material is applied to a substrate and fired to melt the glass frit. When cooled the resistor is a layer of glass having the conductive particles dispersed throughout the glass. Initially the conductive particles were of precious noble metals, such as gold, platinum, silver, etc., including mixtures and alloys of such noble metals, to provide a resistor having good electrical characteristics. To reduce the cost of the resistance materials, vitreous enamel resistance materials have been developed in which non-noble metals are used as the conductive particles. For example, U.S. Pat. No. 3,394,087 to C. Y. D. Huang et al, issued July 23, 1968, entitled "Glass Bonded Resistor Compositions Containing Refractory Metal Nitrides and Refractory Metal" discloses the use of tantalum nitride and tantalum as the conductive particles, and U.S. Pat. No. 3,180,841 to R.M. Murphy et al issued Apr. 27, 1965 entitled "Resistance Material and Resistor Made Therefrom" discloses the use of tungsten carbide and tungsten as the conductive particles.

In order to make electrical connection to the vitreous enamel resistors, it is desirable to provide the resistor with conductive terminations which are applied to the substrate at the ends of the resistor. Such terminations should be highly conductive and compatible with the particular material of the resistor both chemically, and as to the manner of applying the termination and the resistance material. Good terminations have been achieved with materials containing precious noble metals. However, these materials are expensive. There are available termination materials based upon copper and nickel. However, these terminations have been found not to be completely compatible with certain vitreous enamel resistance materials, such as those containing tantalum nitride and tantalum as the conductive material. It is therefore desirable to provide a termination material which is inexpensive, provides all of the noted desirable properties and is also compatible with the vitreous enamel resistance materials containing tantalum nitride and tantalum, as well as other vitreous enamel resistance materials.

Therefore, it is an object of the present invention to provide a novel termination material for electrical components, such as resistors.

It is another object of the present invention to provide a novel vitreous enamel termination material and method of making same.

It is still another object of the present invention to provide a vitreous enamel termination material which does not contain precious noble metals so as to be relatively inexpensive.

It is a further object of the present invention to provide a vitreous enamel termination material and method of making same which is compatible with vitreous enamel resistance materials, such as those containing as the conductive material either tantalum nitride and tantalum or tungsten carbide and tungsten.

It is a still further object of the present invention to provide a termination for electrical components and method for making same which includes a mixture of particles of an alloy of nickel and iron and a glass frit.

Other objects will appear hereinafter.

The invention accordingly comprises a composition of matter and the product formed therewith possessing the characteristics, properties and relation of constituents which will be exemplifed in the composition hereinafter described, and the scope of the invention will be indicated in the claims.

For a fuller understanding of the nature and objects of the invention, reference should be had to the following detailed description taken in connection with the accompanying drawing, in which:

FIG. 1 is a top plan view of an electrical resistor having the termination of the present invention; and FIG. 2 is a sectional view taken along line 2—2 of FIG. 1.

In general, the conductive termination material of the present invention comprises a mixture of a vitreous glass frit and finely divided particles of an alloy of nickel and iron. Elemental particles of nickel and iron can also be used. The alloy particles are present in the mixture in the amount of 45% to 72% by volume. However, 63% by volume of the alloy particles is preferred as providing a termination with the highest conductivity which is the most compatible with the vitreous enamel resistance materials. The amount of nickel and iron in the alloy particles is 36% to 50% by weight of nickel and 64% to 50% by weight of iron. However, 40% to 45% by weight of nickel and 60% to 55% by weight of iron is preferred as providing the best electrical characteristics.

The glass frit used in the termination material of the present invention may be of any well known composition which has a melting temperature below that of the alloy of nickel and iron. The glass frits most preferably used are the borosilicate frits, such as bismuth, cadmium, barium, calcium or other alkaline earth borosilicate frits. The preparation of such glass frits is well known and consists, for example, in melting together the constituents of the glass in the form of the oxides of the constituents, and pouring such molten composition into water to form the frit. The batch ingredients may, of course, be any compound that will yield the desired oxides under the usual conditions of frit production. For example, boric oxide will be obtained from boric acid, silicon dioxide will be produced from flint, barium oxide will be produced from barium carbonate, etc. The coarse frit is preferably milled in a ball mill with water to reduce the particle size of the frit and to obtian a frit of substantially uniform size.

The alloy of nickel and iron may be any commercially available alloy of nickel and iron of the desired ratio of the metals. The alloy may also be formed by mixing together particles of nickel and iron and firing the mixture at about 1400° C. When elemental particles of nickel and iron are used, alloying of them is achieved during the firing of the termination material and/or resistance material.

To make the termination material of the present invention glass frit and −325 mesh particles of the alloy (or its elemental particles), in the desired proportions, are thoroughly mixed together, such as by ball milling in an organic medium, such as butyl carbitol acetate.

The preferred particle size of the milled batch measured with a Fisher sub-sieve sizer is 0.9 to 1.1. The milled batch is then drained from the ball mill and the mixture is dried at a temperature of 100° C to 110° C for 8 to 12 hours to remove any remaining organic medium. The mixture of the glass frit and alloy particles are then mixed with a vehicle suitable for the desired manner of applying the termination material. For example, the mixture can be mixed with a Reusche squeege medium for applying the termination material by screen printing To terminate an electrical component, such as an electrical resistor, the termination material is applied to the surface of a substrate. The substrate may be a body of any material which will withstand the firing temperature of the termination material as well as the temperature and conditions required to apply the resistance material. The substrate is generally a body of a ceramic material, such as glass, porcelain, steatite, barium titinate, alumina or the like. The termination material may be applied on the substrate by brushing, dipping, spraying or screen stencil application. The termination material is then dried to remove any liquid vehicle, such as by heating at 150° C for 5 to 15 minutes. If desired, the termination material on the substrate can then be heated to about 350° C in a non oxidizing or nitrogen atmosphere for about a half an hour to remove any organic binder in the material. The termination material is then fired in a conventional furnace to a temperature at which the glass frit becomes molten. The termination material is preferably fired in an inert atmosphere, such as nitrogen. Although the firing temperature depends on the melting temperature of the glass frit used, for borosilicate glass frit, the termination material may be fired at a temperature between 850° C to 1200° C for a period of one half of an hour to 1 hour. When the substrate and termination material are cooled, there is provided a termination which is a layer of glass having the particles of the alloy of nickel and iron embedded in and dispersed throughout the glass.

Although the termination material of the present invention can be used to terminate many electrical components, it is particularly useful for termination of vitreous enamel resistors wherein the resistance material is a layer of glass having conductive particles embedded in and dispersed throughout the glass layer. More particularly, the termination material of the present invention is most useful in terminating a vitreous enamel resistor in which the conductive particles are a mixture of either tantalum nitride and tantalum or tungsten carbide and tungsten. The resistance material may be applied to the substrate either before or after the termination.

Referring to the drawing, there is shown a resistor, generally designated as 10, which includes a flat substrate 12 of a ceramic material. On a surface of the substrate 12 are two spaced terminations 14 of the termination material of the present invention. Each of the terminations 14 comprises a layer 16 of glass having particles 18 of an alloy of nickel and iron embedded in the glass. On the surface of the substrate 12 between the terminations 14 is a resistance material layer 20. The resistance material layer 20 overlies each of the terminations 14 so as to make contact therewith. Although the resistance material layer 20 is shown as extending over the terminations 14, the terminations 14 can extend over the ends of the resistance material layer 20.

The following examples are given to illustrate certain preferred details of the invention, it being understood that the details of the examples are not to be taken as in any way limiting the invention thereto.

EXAMPLE I

A termination material of the present invention was made by mixing together 63% by volume of particles of an alloy of 36% by weight nickel and 64% by weight iron, with 37% by volume of a glass frit. The glass frit was of the composition by weight, 2% calcium oxide ($C_aO$), 10% magnesium oxide ($M_gO$), 29% boron oxide ($B_2O_3$), 14 aluminum oxide ($Al_2O_3$), and 44% silicon dioxide ($SiO_2$). The mixture was thoroughly mixed together in a ball mill with butyl carbitol acetate for 70 to 100 hours. The mixture was then dried at a temperature of 100° C to 110° C for 8 to 12 hours. The dry mixture was then blended with a vehicle which was a mixture of one half butyl carbitol acetate and one half Reusche screening vehicle on a three roll mill.

The termination material was then applied by silk screen printing to a flat substrate of alumina in a miniature multiplicity of the pattern shown in FIG. 1 of the drawing, to form a plurality of the terminations which were spaced apart about 0.09 inch. The termination material was then dried at 150° C for about 10 minutes. The coated substrates were then fired in a conveyor furnace at 1150° C having a nitrogen atmosphere over a 1 hour cycle.

After the substrate with the terminations 14 thereon had cooled to room temperature, a film of a vitreous enamel resistance material was coated on the substrate between the terminations with the active region of the resistance film being about 0.006 square inch. The resistance material was a mixture of the same glass frit used in the termination material and particles of tantalum nitride and tantalum. The resistance films were dried and then fired in a conveyor furnace at a temperature of between 1100° C to 1200° C and preferably at about 1150° C having a nitrogen atmosphere over a one half hour cycle.

After the resistors made in the manner had cooled, they were subjected to various tests including a moisture test, a short term overload (STOL) test and a temperature cycling test. These tests are standard tests which are described in military specifications MIL-R-83401B.

The moisture test serves to determine the resistance of the component to the deteriorative effects of high humidity and heat conditions. For the purpose of this test, the resistors are subjected to a temperature cycling, while in a high humidity. The resistance of each of the resistors is measured before and after the test to determine any change in resistance and the appearance of the resistors is checked for any mechanical damage.

The short term overload test tests the stability of the resistance film and the termination. For this test, the resistors are subjected to a voltage of about 2.5 times the rated continuous working voltage for about 5 seconds. The resistance of each of the resistors is measured before and after the test to determine any change in resistance, and the resistors are visually checked for physical damage.

The temperature cycle test (also known as thermal shock test) tests the resistance of the component and its elements to exposure at extremes of high and low temperatures and to the shock of alternate exposures to these extremes. The test includes subjecting the resistors to a number of cycles of temperature changes with each cycle including first lowering the temperature to about −55° C, then raising it back to 25° C, then raising it to about 85° C and then lowering it back to 25° C with the resistors being held at each temperature for a specified period of time. The resistance of each of the resistors is measured before and after the test to determine any change in resistance.

The test results for these resistors are shown in Table I.

Table I

| TEST: | % Change in Resistance Average | Span | |
|---|---|---|---|
| Moisture | 1.27 | .03 | 4.05 |
| STOL | −.19 | −.05 | −1.16 |
| Temperature Cycling | .13 | .02 | .66 |

EXAMPLE II

A termination material was made in the same manner as described in Example I except that the particles of the alloy of nickel and iron included 40% by weight of nickel and 60% by weight of iron. The termination material was applied to substrates in the same manner as described in Example I and a resistance material film was applied to each substrate as described in Example I. The test results for these resistors are shown in Table II.

Table II

| TEST: | % Change in Resistance Average | Span | |
|---|---|---|---|
| Moisture | .03 | .06 | .01 |
| STOL | ±.003 | .01 | −.02 |
| Temperature Cycling | .03 | .08 | .01 |

EXAMPLE III

A termination material was made in the same manner as described in Example I, except that the particles of the alloy of nickel and iron included 45% by weight nickel and 55% by weight iron. The termination material was applied to substrates in the same manner as described in Example I and a resistance material film was applied to each substrate as described in Example I. The test results for these resistors are shown in Table III.

Table III

| TEST: | % Change in Resistance Average | | Span |
|---|---|---|---|
| Moisture | ±.05 | .22 | −.30 |
| STOL | ±.01 | .03 | −.07 |
| Temperature Cycling | .03 | .06 | .01 |

EXAMPLE IV

A termination material was made in the same manner as described in Example I, except that the particles of the alloy of nickel and iron included 50% by weight nichel and 50% by weight iron. The termination material was applied to substrates in the same manner as described in Example I and a resistance material film was applied to each substrate as described in Example I. The test results for these resistors are shown in Table IV.

Table IV

| TEST: | % Change in Resistance Average | Span | |
|---|---|---|---|
| Moisture | ±.11 | .29 | −.04 |

Table IV-continued

| TEST: | % Change in Resistance Average | Span | |
|---|---|---|---|
| STOL | ±.02 | .15 | −.02 |
| Temperature Cycling | ±.07 | .30 | −.07 |

EXAMPLE V

A termination material was made in the same manner as described in Example I, except that the particles of the alloy of nickel and iron included 40% by weight nickel and 60% by weight iron. The termination material was applied to substrates in the same manner as described in Example I. A resistance material film was applied to each substrate in the manner described in Example I, except that the resistance material included as the conductive particles a mixture of tungsten carbide and tungsten fired in a conveyor furnace at 950° C in nitrogen over a one half hour cycle. The test results for these resistors are shown in Table V.

Table V

| TEST: | % Change in Resistance Average | Span | |
|---|---|---|---|
| Moisture | ±.02 | .04 | −.05 |
| STOL | ±.05 | .18 | −.17 |
| Temperature Cycling | ±.02 | .05 | −.02 |

EXAMPLE VI

A termination material was made in the same manner as described in Example I, except that the particles of the alloy of nickel and iron included 50% by weight nickel and 50% by weight iron. The termination material was applied to substrates in the same manner as described in Example I. A resistance material film was applied to each substrate in the manner described in Example V. The test results for these resistors are shown in Table VI.

Table VI

| TEST: | % Change in Resistance Average | Span | |
|---|---|---|---|
| Moisture | ±.03 | .06 | −.03 |
| STOL | ±.07 | .51 | −.29 |
| Temperature Cycling | ±.01 | .08 | −.03 |

The terminations of the above examples provided a sheet resistance in the order of 0.2 ohms per square or less. When a termination material was made in accordance with Example V, except that particles of elemental nickel and elemental iron were used in the proportion by weight of 40% nickel and 60% iron, the sheet resistance was also found to be in the order of 0.2 ohms per square or less. The junction resistance between the termination material with the elemental nickel and iron particles and the tungsten carbide and tungsten resistor material was similar to the junction resistance provided by the termination made with nickel-iron alloy particles.

It is noted that the termination material may be applied to the substrate either before or after the resistance material is applied to the substrate as illustrated by the following example.

Example VII

A termination material was made in the same manner as described in Example I, except that the particles of the alloy of nickel and iron included 50% by weight of nickel and 50% by weight or iron. A resistance material film was first applied to each substrate and fired in the manner described in Example I, with the pattern being that shown in FIG. 1. The termination material was then applied to the substrate in the same manner as described in Example I to provide a pair of terminations as shown in FIG. 1, except that the terminations had portions which extended over the resistive layer with the resistive layer extending between the pair of terminations. A first batch of terminations was fired at 850° C in a conveyor furnace having a nitrogen atmosphere over a 1 hour cycle. A second batch of terminations in which the materials were applied with the pattern of Example I was fired at 1050° C. The terminated resistors were tested by being subjected to a heat soak or high temperature exposure test.

The heat soak test is to determine the effect on the resistors of subjecting them to an elevated temperature over an extended period of time. For this test the resistors are placed in a chamber at 150° C with no load on the resistors and are retained at the elevated temperature for an extended period of time. The resistance values of the resistors are measured before the test and at set intervals during the test to determine any changes in resistance.

After the resistors had been subjected to 150° C temperature for 1000 hours, the resistors of both the first and second batches had an average change in resistance of 0.11%, indicative of the high degree of stability of the termination.

The present invention may be embodied in other specific forms without departing from the spirit or essential attributes thereof, and accordingly, reference should be made to the appending claims, rather than to the foregoing specification as indicating the scope of the invention.

What is claimed is:

1. A conductive termination material for electrical components comprising a mixture of fine metal particles of an alloy of nickel and iron and a glass frit.

2. A termination material in accordance with claim 1 in which the mixture contains 45% to 72% by volume of the alloy particles.

3. A termination material in accordance with claim 2 in which the mixture contains 63% by volume of the alloy particles.

4. A termination material in accordance with claim 2 in which the alloy particles contain 36% to 50% by weight of nickel.

5. A termination material in accordance with claim 4 in which the alloy particles contain 40% to 45% by weight of nickel.

6. An electrical termination device for a resistor comprising a substrate, a termination on the substrate, said termination comprising a layer of glass having particles of an alloy of nickel and iron dispersed throughout the glass layer.

7. An electrical device in accordance with claim 6 in which the termination contains 45% to 72% by volume of the alloy particles.

8. An electrical device in accordance with claim 6 in which the termination contains 63% by volume of the alloy particles.

9. An electrical device in accordance with claim 8 in which the alloy contains 36% to 50% by weight of nickel.

10. An electrical device in accordance with claim 9 in which the alloy contains 40% to 45% by weight of nickel.

11. An electrical device in accordance with claim 6 including a film of a resistance material on the substrate contacting the termination.

12. An electrical device in accordance with claim 11 in which the resistance material comprises a layer of glass having particles of a conductive material dispersed throughout the glass layer.

13. An electrical device in accordance with claim 12 in which the conductive particles of the resistance material are a mixture of tantalum nitride and tantalum.

14. An electrical resistor in accordance with claim 12 in which the conductive particles of the resistance material are a mixture of tungsten carbide and tungsten.

15. A method of making an electrical termination device for a resistor wherein a vitreous enamel termination composition is applied to a substrate comprising the steps of preparing a vitreous enamel termination composition comprising a glass frit and finely divided conductive particles of nickel and iron, applying a layer of the composition to an insulating substrate, firing the coated substrate in a non oxidizing atmosphere sufficient to form an adherent vitreous composite, and cooling the coated substrate to form a termination thereon having a glass matrix with conductive particles dispersed therein.

16. The method of claim 15 in which the terminal composition is fired in nitrogen at a temperature between 850° and 1200° C.

17. The method of claim 15 in which the metal particles of the termination mixture are an alloy of nickel and iron.

18. The method of claim 17 in which the termination composition contains 45% to 72% by volume of the alloy particles.

19. The method of claim 18 in which the termination composition contains 63% by volume of the alloy particles.

20. The method of claim 18 in which the alloy particles of the termination composition contain 36% to 50% by weight of nickel.

21. The method of claim 20 in which the alloy particles of the termination composition contain 40% to 45% by weight of nickel.

22. The method of claim 15 which includes the step of forming on the substrate in contact with the termination a vitreous enamel resistor comprising a layer of glass having particles of a conductive material dispersed throughout the glass layer.

23. The method of claim 22 in which the conductive particles of the resistor are a mixture of tantalum nitride and tantalum.

24. The method of claim 22 in which the conductive particles of the resistor are a mixture of tungsten carbide and tungsten.

25. The method of claim 22 in which the vitreous enamel resistor is formed on the substrate after the application and firing of the termination layer on the substrate.

26. The method of claim 22 in which the vitreous enamel resistor is formed by applying and firing a resistive layer on the substrate before the application and firing of the termination layer on the substrate in contact with the resistor.

27. An electrical termination device for a resistor made by preparing a vitreous enamel termination composition comprising a glass frit and finely divided conductive particles of nickel and iron, applying a layer of the composition to an insulating substrate.

firing the coated substrate in a non oxidizing atmosphere sufficient to form an adherent vitreous composite, and cooling the coated substrate to form a termination thereon having a glass matrix with conductive particles dispersed therein.

28. An electrical device made in accordance with claim 27 in which the terminal composition is fired in nitrogen at a temperature between 850° C and 1200° C.

29. An electrical device made in accordance with claim 27 in which the metal particles of the termination mixture are an alloy of nickel and iron.

30. An electrical device made in accordance with claim 29 in which the termination composition contains 45% to 72% by volume of the alloy particles.

31. An electrical device made in accordance with claim 30 in which the termination composition contains 63% by volume of the alloy particles.

32. An electrical device made in accordance with claim 30 in which the alloy particles of the termination composition contain 36% to 50% by weight of nickel.

33. An electrical device made in accordance with claim 32 in which the alloy particles of the termination composition contain 40% to 45% by weight of nickel.

34. An electrical device made in accordance with claim 27 which includes the step of forming on the substrate in contact with the termination a vitreous enamel resistor comprising a layer of glass having particles of a conductive material dispersed throughout the glass layer.

35. An electrical device made in accordance with claim 34 in which the conductive particles of the resistor are a mixture of tantalum nitride and tantalum.

36. An electrical device made in accordance with claim 34 in which the conductive particles of the resistor are a mixture of tungsten carbide and tungsten.

37. An electrical device made in accordance with claim 34 in which the vitreous enamel resistor is formed on the substrate after the application and firing of the termination layer of the substrate.

38. An electrical device made in accordance with claim 34 in which the vitreous enamel resistor is formed by applying and firing a resistive layer on the substrate before the application and firing of the termination layer on the substrate in contact with the resistor.

* * * * *